US011273664B2

(12) United States Patent
Hezari et al.

(10) Patent No.: US 11,273,664 B2
(45) Date of Patent: Mar. 15, 2022

(54) SPIKE ASSEMBLY

(71) Applicants: Alex Hezari, Baulkham Hills (AU); Armando Camacho, West Pennant Hills (AU)

(72) Inventors: Alex Hezari, Baulkham Hills (AU); Armando Camacho, West Pennant Hills (AU)

( * ) Notice: Subject to any disclaimer, the term of this patent is extended or adjusted under 35 U.S.C. 154(b) by 0 days.

(21) Appl. No.: 16/623,762

(22) PCT Filed: Jun. 17, 2018

(86) PCT No.: PCT/AU2018/050599

§ 371 (c)(1),
(2) Date: Dec. 17, 2019

(87) PCT Pub. No.: WO2018/227255

PCT Pub. Date: Dec. 20, 2018

(65) Prior Publication Data

US 2020/0130402 A1 Apr. 30, 2020

(30) Foreign Application Priority Data

Jun. 17, 2017 (AU) ..... 2017902319

(51) Int. Cl.
*B42F 13/12* (2006.01)
*B42F 13/14* (2006.01)
(Continued)

(52) U.S. Cl.
CPC ..... *B42F 13/404* (2013.01); *A47F 10/06* (2013.01); *B26F 1/24* (2013.01); *B42F 13/12* (2013.01); *B42F 13/14* (2013.01)

(58) Field of Classification Search
CPC .. B42F 13/12; B42F 13/14; B26F 1/24; A47F 10/06
(Continued)

(56) References Cited

U.S. PATENT DOCUMENTS 170,202 A * 11/1875 Stephenson ..... B42F 13/12 402/25
562,444 A * 6/1896 Wallace ..... B42F 13/12 402/70
(Continued)

FOREIGN PATENT DOCUMENTS

GB 171306 A 11/1921
GB 206720 A 11/1923

OTHER PUBLICATIONS

International Search Report dated Aug. 21, 2018, issued in PCT Patent Application No. PCT/AU2018/050599, 4 pages.
(Continued)

*Primary Examiner* — Kyle R Grabowski
(74) *Attorney, Agent, or Firm* — Thomas M. Joseph, Esq

(57) ABSTRACT

In a first aspect there is disclosed a spike assembly (10) including a base (12) and a spike formation (14) operatively attached to the base (12). The spike formation (14) is adapted to hold a plurality of impaled sheets and includes an elongate spike (16) longitudinally extending between a base end (18) and an impale end (20). The base end (18) of the spike (16) is operatively adapted for attachment to the base (12). The spike assembly (12) further includes a (i) handle (26) operatively associated with the spike formation (14) and moveable relative to the spike formation to apply force to a sheet to be impaled on the spike formation, and (ii) a guide assembly (28) operatively adapted to guide movement of the handle (26) relative to the spike formation (14).

10 Claims, 4 Drawing Sheets

(51) Int. Cl.

| | |
|---|---|
| ***B26F 1/24*** | (2006.01) |
| ***B42F 13/40*** | (2006.01) |
| ***A47F 10/06*** | (2006.01) |

(58) Field of Classification Search
USPC ..... 402/68, 69; 24/67.3, 67 P
See application file for complete search history.

(56) References Cited

U.S. PATENT DOCUMENTS

| | | | | | |
|---|---|---|---|---|---|
| 1,213,378 | A | | 1/1917 | Jensen | |
| 1,522,429 | A | * | 1/1925 | Ferle | B42F 13/12 402/25 |
| 1,705,306 | A | * | 3/1929 | O'Neil | B42F 13/12 402/68 |
| 2,116,369 | A | * | 5/1938 | Stolp | B42F 13/12 402/45 |
| 2,463,767 | A | | 3/1949 | Hayman | |
| 2,469,540 | A | * | 5/1949 | Anderson | B42F 13/12 402/70 |
| 2,520,361 | A | * | 8/1950 | Gilbert | B42F 13/12 402/25 |
| 2,760,491 | A | | 8/1956 | Fowler | |
| 2,925,085 | A | * | 2/1960 | Pilkinton | B42F 13/12 402/25 |

OTHER PUBLICATIONS

U.S. Pat. No. 417,110, Issue Date Dec. 10, 1889, Inventor Stansbury; R.P. (This patent is listed here because the patent number is six digits).

U.S. Pat. No. 775,159, Issue Date Nov. 15, 1904, Inventor Womble; J.P. (This patent is listed here because the patent number is six digits).

Reid;Deborah, "The Most Important Restaurant Tool is a $3 Piece of Metal", Jan. 6, 2017, https://www.eater.com/2017/1/6/14184622/receipt-spike-chit-peg-restaurant-history.

* cited by examiner

SPIKE ASSEMBLY

CROSS REFERENCE TO RELATED APPLICATIONS

The present application is a U.S. national stage application of PCT International Application No. PCT/AU2018/050599, filed Jun. 17, 2018, and published as PCT Publication WO/2018/227255 on Dec. 12, 2018, which claims priority to Australian Application No. AU 2017902319, filed on Dec. 17, 2017. The disclosures of all the foregoing applications are hereby incorporated by reference in their entirety into the present application.

FIELD

The invention concerns a spike assembly, in particular but not exclusively, a spike assembly of the type referred to as a "receipt spike" used for holding receipts and other documents.

BACKGROUND

Receipt spikes, also known as dock spikes, bill spikes or stationary spindles, are common stationary utensils employed at restaurant check outs for holding receipts or food orders. A typical receipt spike includes a base and a spike which outwardly extends from the base upon which receipts are impaled by a user.

A drawback of conventional receipt spikes is that they are prone to causing injuries. As an amount of force is required to impale a receipt, particularly when a number of receipts are impaled simultaneously, an ill directed impaling action by a user could cause injury. In a busy restaurant setting it is not uncommon for a user to pay insufficient attention while impaling receipts resulting in injury.

OBJECT

It is an object of the present invention to provide a spike assembly which at least ameliorates one or more of the problems associated with existing receipt spikes or which provides a useful alternative.

SUMMARY

According to a first aspect there is disclosed herein a spike assembly including:

a base;

a spike formation operatively attached to the base and adapted to hold a plurality of sheets impaled on the spike formation, the spike formation including an elongate spike longitudinally extending between a base end and an impale end, the base end of the spike operatively adapted for attachment to the base;

a handle operatively associated with the spike formation and moveable relative to the spike formation so as to apply force to a sheet to be impaled on the spike formation; and a guide assembly operatively adapted to guide movement of the handle relative to the spike formation.

Preferably the spike formation includes a tubular sheet sleeve, the sheet sleeve defining a spike slot operatively adapted to slidably receive the spike.

Preferably the sheet sleeve includes a sleeve collar operatively located towards the base end of the spike.

Preferably the guide assembly includes an elongate guide member operatively attached to the base so as to be co-extensive with the spike.

Preferably the handle includes a guide member compartment operatively adapted to slidably receive the guide member.

Preferably the guide member is adapted to slidably move along the guide member compartment when a force is applied by the handle.

Preferably the guide member compartment includes biasing means operatively adapted to move between a biased and an unbiased condition, wherein the biasing means is adapted to be placed in the biased condition upon the handle undergoing movement relative to the guide member to apply force to a sheet of material.

Preferably the biasing means is a coil spring.

Preferably the guide member is a first guide member and the guide member compartment is a first guide member compartment, wherein the guide assembly includes a second guide member and a second guide member compartment operatively adapted to slidably receive the second guide member.

Preferably the handle includes a spike compartment operatively adapted to slidably receive the spike formation when the handle is caused to undergo movement relative to the spike.

Preferably the spike assembly includes a fastener operatively adapted for attachment to the sheet sleeve.

Preferably the fastener includes a gripping formation adapted to grip an outer surface of the sheet sleeve.

BRIEF DESCRIPTION OF THE DRAWINGS

Preferred embodiments of the invention will be described hereinafter, by way of examples only, with reference to the accompany drawings, wherein.

DESCRIPTION OF PREFERRED EMBODIMENTS

Figure 1:
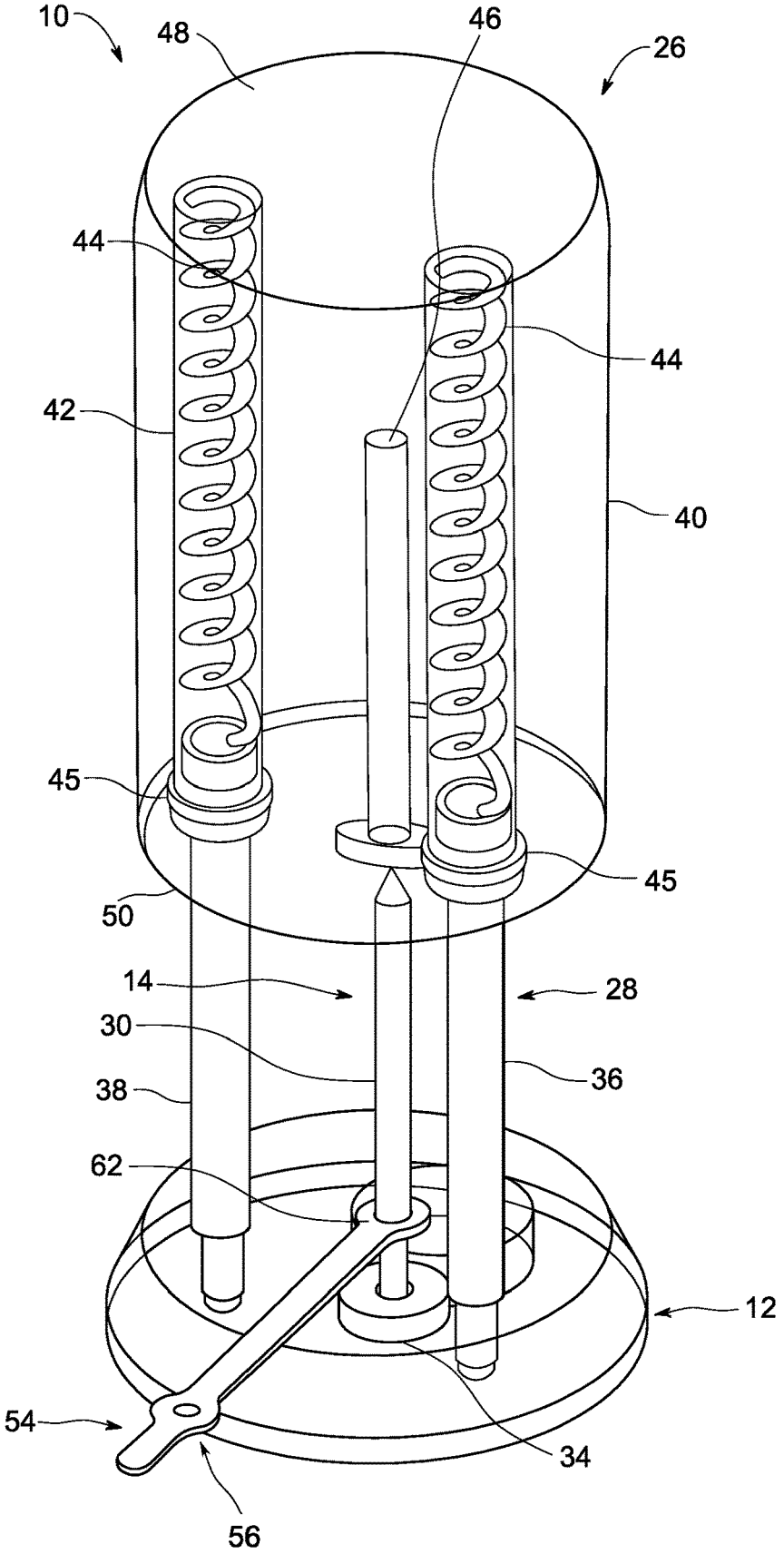
FIG. 1 is a schematic perspective view of an embodiment spike assembly.
Figure 2:
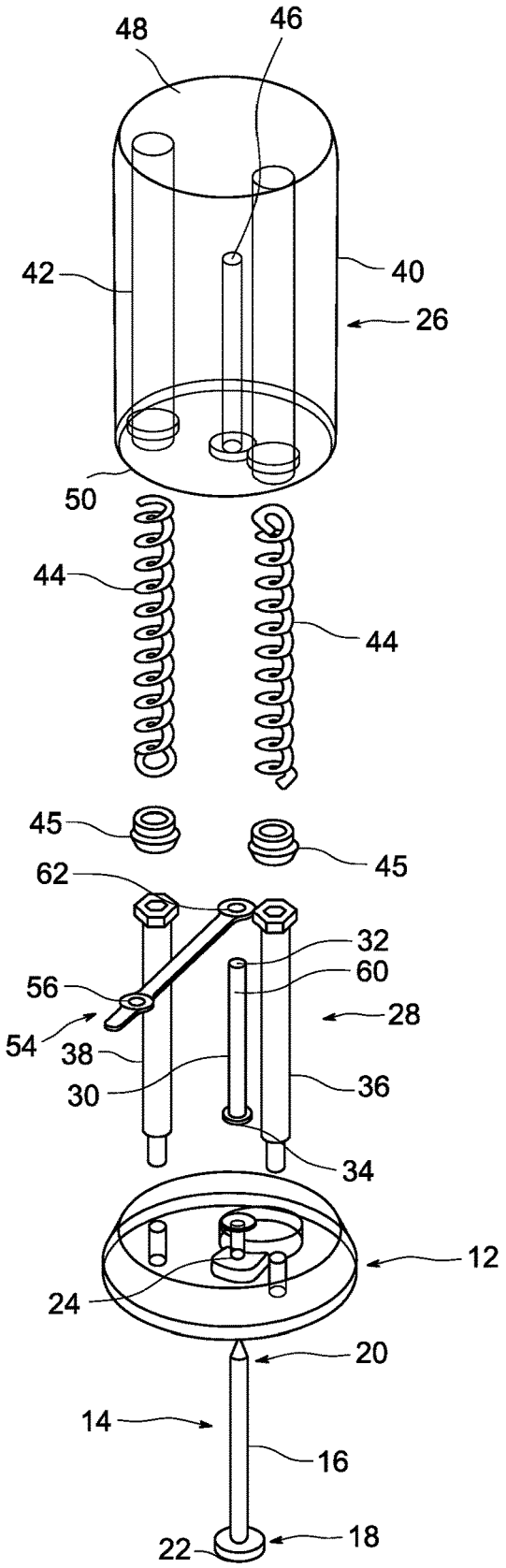
FIG. 2 is a schematic exploded perspective view of the spike assembly of FIG. 1.

FIGS. 1 and 2 show an embodiment spike assembly, generally indicated with the reference numeral 10. The spike assembly 10 includes a base 12 and a spike formation 14 operatively attached to the base 12. The spike formation 14 is adapted to hold a plurality of non-illustrated sheets impaled on the spike formation 14. Typically the spike assembly 10 will be used to impale sheets, for example paper receipts at a restaurant check out. The spike formation 14 includes an elongate spike 16, the spike 16 longitudinally extending between a base end 18 and a inwardly tapering impale end 20. The base end 18 of the spike 16 is operatively adapted for attachment to the base 12. In this embodiment the base end 18 includes a threaded outer surface 22 adapted to engage a complimentary threaded cavity 24 in the base 12.

The spike assembly 10 further includes a handle 26 operatively associated with the spike formation 14. The handle 26 is moveable relative to the spike formation 14 so as to apply force to a non-illustrated sheet to be impaled on the spike formation 14. The spike assembly 10 includes a guide assembly 28 operatively adapted to guide movement of the handle 26 relative to the spike formation 14. A user seeking to impale a receipt on the spike 16 can locate a receipt between the impale end 20 and the handle 26. The user can now apply a force to the handle 26 so as to cause the handle 26 to move downwardly relative to the guide assembly 28. Continued downward movement of the handle 26 will cause the receipt to be impaled on the spike 16 of the spike formation 14. Due to the presence of the handle 26 the user is protected against the possibility of injury being inflicted by the impale end 20. Furthermore, as the impale end 20 is covered by the handle 26 injury by inattentive persons in a restaurant setting is also deterred.

The spike formation 14 includes a tubular sheet sleeve 30. The sheet sleeve 30 defines a spike slot 32 operatively adapted to slidably receive the spike 16. The sheet sleeve 30 includes a sleeve collar 34 which is operatively located towards the base end 18 of the spike 16.

The guide assembly 28 includes a first and a second elongate guide member 36, 38 operatively attached to the base 12 and co-extensive with the spike 12. In this embodiment the guide members 36, 38 are parallel and laterally spaced apart. The handle 26 includes a first and second guide member compartment 40, 42 operatively adapted respectively to receive the first and second guide members 36, 38 slidably. The first and second guide members 36, 38 are adapted to move along the first and second guide member compartments 40, 42 respectively when a force is applied by a user on the handle 26.

The first and second guide member compartments 40, 42 each includes biasing means 44 operatively adapted to move between a biased and an unbiased condition. In this embodiment the biasing means 44 is adapted to be placed in the biased condition upon the handle 26 undergoing movement relative to the first and second guide members 36, 38 to apply force to a sheet of paper to be impaled. In this embodiment the biasing means 44 includes a coil spring. Each coil spring 44 is located respectively in the first or the second guide member compartments 40, 42. The first and second guide member compartments 40, 42 include stop members 45 adapted to secure the springs 44 in position.

Figure 3:
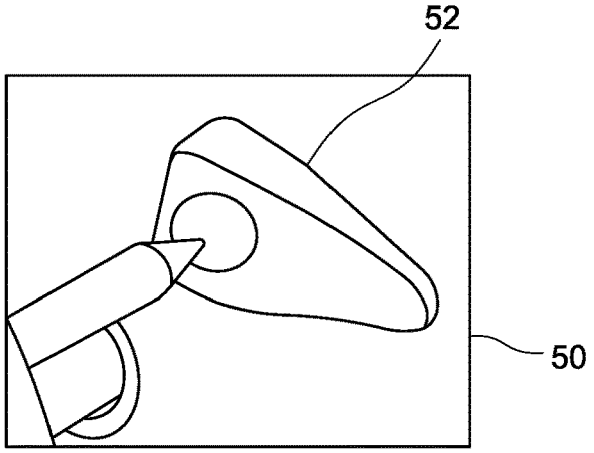
FIG. 3 is a schematic bottom perspective view of a portion of a handle of the spike assembly of FIG. 1.

The handle 26 includes a spike compartment 46 operatively adapted to receive the spike formation 14 slidably when the handle 26 is caused to undergo movement relative to the spike 16. The handle 26 has a user end 48 and a base end 50 with the base end 50 facing the base 12. The base end 50 includes a finger guide 52, shown in FIG. 3, operatively adapted to guide movement of a finger of a user so as to indicate the location of the spike 16 should the user wish to use a single hand to impale a receipt without use of the handle 26.

The spike assembly 10 includes a fastener 54 operatively adapted for attachment to the sheet sleeve 30. The fastener 54 further includes a gripping formation 56 adapted to grip an outer surface 60 of the sheet sleeve 30 adjacent an uppermost impaled sheet. As shown, the fastener 54 includes a sleeve opening 62 for receiving the sheet sleeve 30 and is located adjacent the sleeve collar 34. When the sheet sleeve 30 has been filled with receipt sheets, the spike 16 can be slidably removed from the sheet sleeve 30 and the base 12. The sheet sleeve 30 can then be removed from the spike assembly 10 while holding the receipts. The gripping formation 56 can hereafter be placed on the end of the sheet sleeve 30 opposite the sleeve collar 34 to ensure the receipts are held on the sheet sleeve 30. A fresh, unfilled sheet sleeve 30 can finally be slid onto the spindle 16 before it is again secured to the base 12.

Figure 4:
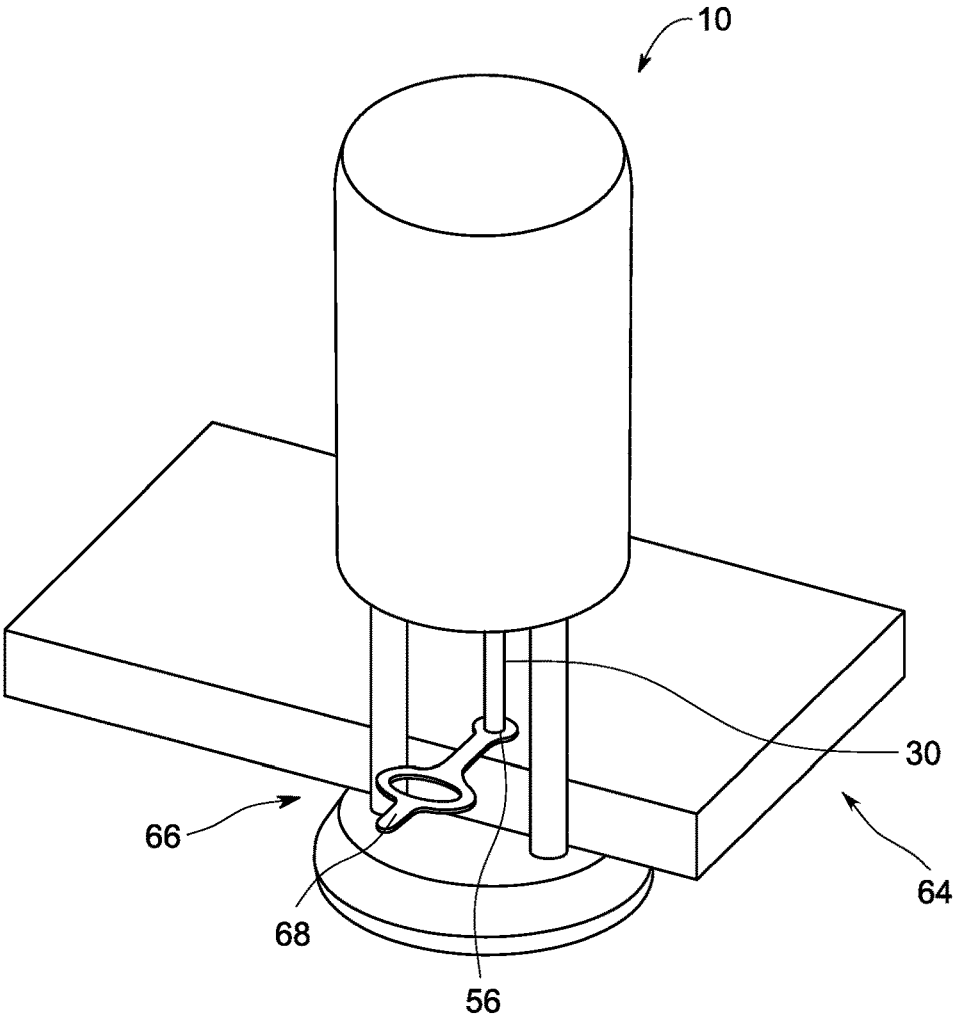
FIG. 4 is a schematic perspective view of a second embodiment spike assembly holding documents.
Figure 5:
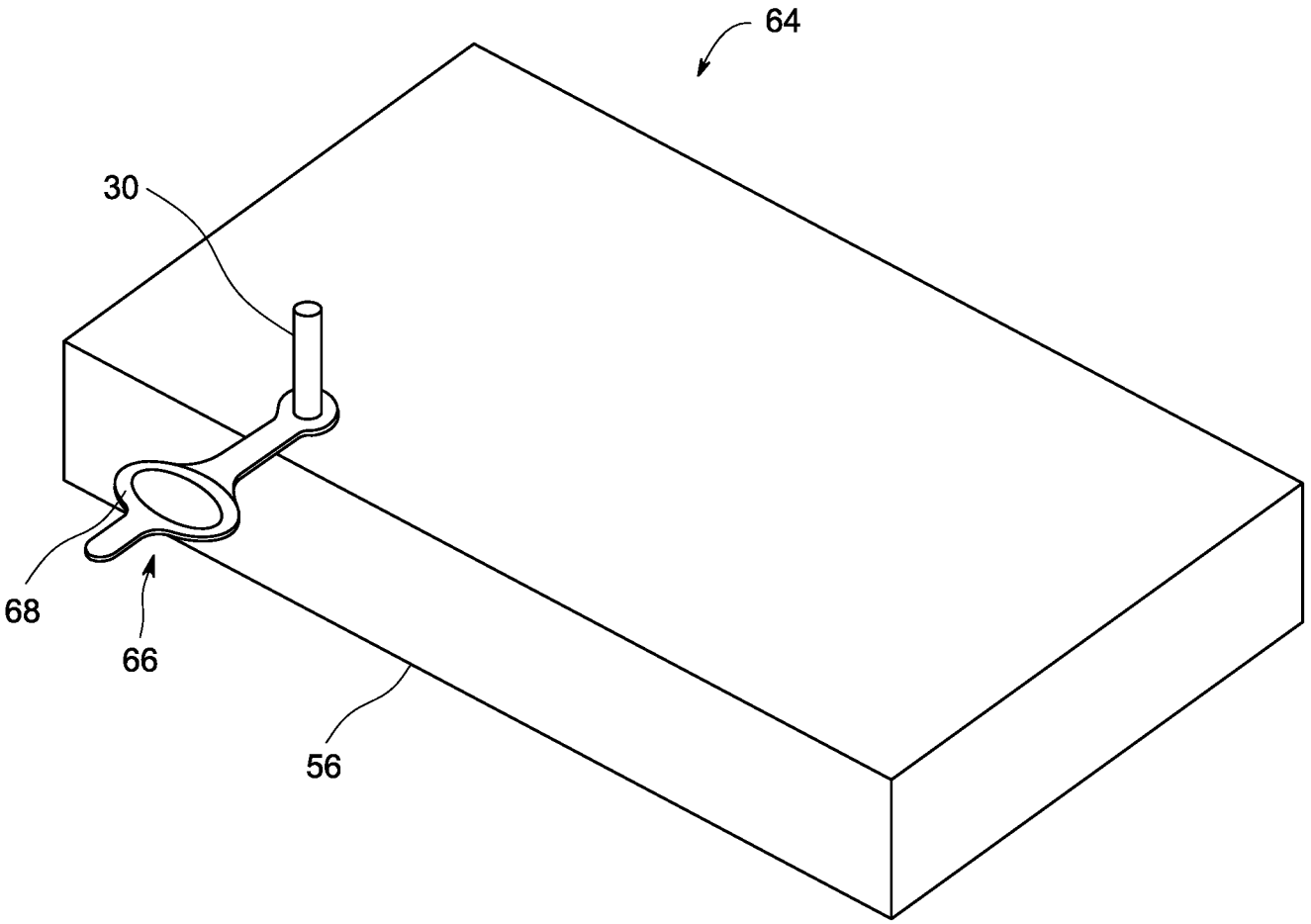
FIG. 5 is a schematic perspective view of the documents of FIG. 4 having been removed from the spike assembly.

FIGS. 4 and 5 show a spike assembly 10 holding a stack of receipts 64. The spike assembly 10 includes a second embodiment fastener 66 located on the sheet sleeve 30. The fastener 66 secures the stack of receipts 64 between a gripping formation 56 of the fastener 66 and the non-visible sleeve collar of the fastener 66. The fastener 66 includes a holed tab 68. The holed tab 68 can be used for hanging and handling the stack of receipts 64.

It is pointed out that the orientation of the guide members 36, 38 are such that they co-operate to ensure proper alignment of the receipts upon the sheet sleeve 30.

It is further pointed out that the handle 26 could be removed and replaced with, for example, a flat disc so that the spike assembly 10 can be used as a normal receipt spike, but having a protective guard (the flat disc) protecting the spike.

It is further pointed out that the base 12 and the handle 26 could be branded with adverting material. The handle 26 could, for example, be produced in the shape of a Coca-Cola™ can.

Although the invention has been described with reference to specific examples, it will be appreciated by those skilled in the art that the invention may be embodied in many other forms.

The invention claimed is:

1. A spike assembly including:

a base;

a spike formation operatively attached to the base and adapted to hold a plurality of sheets impaled on the spike formation, the spike formation including an elongate spike longitudinally extending between a base end and an impale end, the base end of the spike operatively adapted for attachment to the base;

a handle operatively associated with the spike formation and moveable relative to the spike formation so as to apply force to a sheet to be impaled on the spike formation; and a guide assembly operatively adapted to guide movement of the handle relative to the spike formation;

wherein the guide assembly includes an elongate guide member operatively attached to the base so as to be coextensive with the spike;

wherein the handle includes a guide member compartment operatively adapted to slidably receive the guide member;

wherein the guide member is adapted to slidably move along the guide member compartment when a force is applied by the handle;

wherein the guide member compartment includes biasing means operatively adapted to move between a biased and an unbiased condition; and wherein the biasing means is adapted to be placed in the biased condition upon the handle undergoing movement relative to the guide member to apply force to a sheet of material.

2. A spike assembly according to claim 1, wherein the biasing means is a coil spring.

3. A spike assembly according to claim 2, wherein the guide member is a first guide member and the guide member compartment is a first guide member compartment, wherein the guide assembly includes a second guide member and a second guide member compartment operatively adapted to slidably receive the second guide member.

4. A spike assembly according to claim 3, wherein the handle includes a spike compartment operatively adapted to slidably receive the spike formation when the handle is caused to undergo movement relative to the spike.

5. A spike assembly according to claim 4, wherein the spike assembly includes a fastener operatively adapted for attachment to the sheet sleeve.

6. A spike assembly according to claim 5, wherein the fastener includes a gripping formation adapted to grip an outer surface of the sheet sleeve.

7. A spike assembly including:

a base;

a spike formation operatively attached to the base and adapted to hold a plurality of sheets impaled on the spike formation, the spike formation including an elongate spike longitudinally extending between a base end and an impale end, the base end of the spike operatively adapted for attachment to the base;

a handle operatively associated with the spike formation and moveable relative to the spike formation so as to apply force to a sheet to be impaled on the spike formation; and a guide assembly operatively adapted to guide movement of the handle relative to the spike formation;

wherein the spike formation includes a tubular sheet sleeve, the sheet sleeve defining a spike slot operatively adapted to slidably receive the spike;

wherein the guide assembly includes an elongate guide member operatively attached to the base so as to be coextensive with the spike;

wherein the guide assembly includes an elongate guide member operatively attached to the base so as to be coextensive with the spike;

wherein the handle includes a guide member compartment operatively adapted to slidably receive the guide member;

wherein the guide member is adapted to slidably move along the guide member compartment when a force is applied by the handle; and wherein the guide member compartment includes biasing means operatively adapted to move between a biased and an unbiased condition, wherein the biasing means is adapted to be placed in the biased condition upon the handle undergoing movement relative to the guide member to apply force to a sheet of material.

8. A spike assembly according to claim 7, wherein the biasing means is a coil spring.

9. A spike assembly according to claim 8, wherein the guide member is a first guide member and the guide member compartment is a first guide member compartment, wherein the guide assembly includes a second guide member and a second guide member compartment operatively adapted to slidably receive the second guide member.

10. A spike assembly according to claim 9, further comprising:

a fastener operatively adapted for attachment to the sheet sleeve with the fastener including a gripping formation adapted to grip an outer surface of the sheet sleeve;

wherein the handle includes a spike compartment operatively adapted to slidably receive the spike formation when the handle is caused to undergo movement relative to the spike; and wherein the guide assembly includes an elongate guide member operatively attached to the base so as to be coextensive with the spike.

* * * * *